US007269857B2

(12) United States Patent
Cymbol

(10) Patent No.: US 7,269,857 B2
(45) Date of Patent: Sep. 18, 2007

(54) BIB WITH AN IMPROVED POCKET

(75) Inventor: Rea Elizabeth Cymbol, Calgary (CA)

(73) Assignee: Rea E. Cymbol, Calgary, AB (CA)

( * ) Notice: Subject to any disclaimer, the term of this patent is extended or adjusted under 35 U.S.C. 154(b) by 0 days.

(21) Appl. No.: 11/333,735

(22) Filed: Jan. 18, 2006

(65) Prior Publication Data

US 2007/0157357 A1 Jul. 12, 2007

(51) Int. Cl.
*A41B 13/10* (2006.01)

(52) U.S. Cl. ..... 2/49.2; 2/49.1

(58) Field of Classification Search ..... 2/49.1, 2/49.2, 49.4, 48, 51, 49.5, 49.3, 50, 52, 88, 2/89, 247, 248; D2/860–864
See application file for complete search history.

(56) References Cited

U.S. PATENT DOCUMENTS

| | | | | | |
|---|---|---|---|---|---|
| 563,644 | A | * | 7/1896 | Birney | 2/49.2 |
| 2,473,740 | A | | 6/1949 | Welch | 2/48 |
| 2,569,915 | A | | 10/1951 | Arseneault | 2/49 |
| 2,629,871 | A | | 3/1953 | Greene | 2/51 |
| 3,146,465 | A | | 9/1964 | Hummel | 2/49 |
| 3,540,060 | A | * | 11/1970 | Brown | 2/49.2 |
| D238,521 | S | | 1/1976 | Anderson | 2/49 |
| 4,445,231 | A | | 5/1984 | Noel | 2/49 |
| 4,601,065 | A | | 7/1986 | Sigl et al. | 2/49 |
| 4,646,365 | A | | 3/1987 | Suprise et al. | 2/49 |
| 4,663,779 | A | | 5/1987 | Bible | 2/49 |
| 4,706,303 | A | | 11/1987 | Van Gompel et al. | 2/49 |
| 4,779,288 | A | | 10/1988 | Mack | 2/49 |
| 4,793,004 | A | | 12/1988 | Long et al. | 2/49 |
| 4,924,527 | A | | 5/1990 | Huntermeyer | 2/49 |
| 5,218,721 | A | | 6/1993 | Mathews et al. | 2/49 |
| D350,220 | S | * | 9/1994 | Lindy | D2/864 |
| 5,490,289 | A | * | 2/1996 | Lehrer | 2/49.2 |
| 5,504,941 | A | | 4/1996 | Sell | 2/49 |
| D383,891 | S | * | 9/1997 | Hill | D2/864 |

(Continued)

*Primary Examiner*—Amy B. Vanatta

(57) ABSTRACT

A barrier against soiling to the wearer, this functional, easy to use bib comprises a body made of washable, flexible, durable and non-porous material with a front and a back. The body includes two semi-circular upper sections that protect the wearer's shoulders from soiling while also securing the bib around the wearer's neck. In fastening these upper sections together, a portion of the bib body arcs outwardly to conform to the wearer's upper body. The lower body of the bib forms into a bowed pocket for catching and retaining food particles and liquid thus shielding the user from soiling. The pocket is formed firstly by folding the lowest portion of the body upwards toward the front of the bib and fastening with corresponding snaps on each side and secondly, by folding the bottom right and left corners of the pocket around to the backside of the bib and fastening to the corresponding snaps on the backside. The pocket unfastens for the purpose of wiping and/or washing once removed from the wearer. The integrity of this pocket to retain liquid and food particles is assured and maintained by the special manner in which it is constructed, folded and fastened; by eliminating any folds within the pocket itself; by eliminating any perforations caused by affixing within said pocket, and by avoiding the use of applied trim along its edges. The resulting bib with an improved pocket prevents soiling to the wearer by catching and retaining a measurable amount of food and liquid debris without leaking and is easy to clean due to the ability to unfasten the pocket.

10 Claims, 8 Drawing Sheets

U.S. PATENT DOCUMENTS

| | | | | |
|---|---|---|---|---|
| 5,715,542 | A | 2/1998 | Reinhart, Jr. | 2/49 |
| 5,822,792 | A | 10/1998 | Reinhart, Jr. | 2/49 |
| 5,918,311 | A | 7/1999 | Lampson et al. | 2/49 |
| 6,058,506 | A | 5/2000 | Reinhart, Jr. | 2/49 |
| 6,081,923 | A * | 7/2000 | Marks | 2/49.3 |
| 6,105,165 | A | 8/2000 | Johnson et al. | 2/49 |
| 6,128,780 | A | 10/2000 | Reinhart et al. | 2/49 |
| 6,209,133 | B1 * | 4/2001 | Hinshaw | 2/49.1 |
| 6,237,150 | B1 | 5/2001 | Lucas | 2/49 |
| 6,334,220 | B1 | 1/2002 | Frye | 2/49 |
| 6,363,530 | B1 | 4/2002 | Lampson et al. | 2/49 |
| 6,381,751 | B1 * | 5/2002 | Benjamin et al. | 2/49.2 |
| 2002/0069446 | A1 * | 6/2002 | Pinckney et al. | 2/49.1 |

* cited by examiner

BIB WITH AN IMPROVED POCKET

TECHNICAL FIELD

This invention relates generally to protective coverings for clothing, and more specifically to a bib that has an improved leak-proof, bowl-like pocket in its lower section, which quickly and easily unsnaps to facilitate cleaning.

BACKGROUND

The most common use of a bib is in feeding babies and young children. Senior citizens, mentally and physically handicapped persons, and patrons of restaurants also use bibs.

Most commonly, bibs are made from cloth and only serve to protect a small portion of clothing directly below the bib or are merely decorative in nature therefore not providing adequate protection to the wearer. Also, cloth bibs need to be washed frequently creating a need for multiple cloth bibs for each wearer.

Some other bibs made from rigid, plastic type materials with permanently formed troughs in the lower body, are able to catch and retain solids and liquids, but unfortunately can be both uncomfortable and potentially unsafe to the user due to the nature of the rigid material used which extends to the upper sections to secure the bib around the wearer's neck.

A proposed solution for the cleaning problem was a bib that was designed to have a temporary pocket at its lower section that allowed it to be opened and easily wiped end cleaned by folding a flap in the lower section upward and folding the two corners around to the back of the bib to be fastened. The obvious flaw associated with this proposal is preventing liquid and food debris from leaking at the bib's corners.

Previous patents disclose bibs having a pocket structure for receiving solids and liquids, which would otherwise soil the wearer's clothing. An example of a prior proposal for a bib with a temporary pocket formed in its tower body is U.S. Pat. No. 5,504,941 issued Apr. 9, 1996 to Sell. Sail presents an improvement to pocket structures however, the nature in which the lower section is folded and fastened in this invention is done in such a manner that the folds themselves are found on the inside of the pocket which allows food particles and liquid to escape from the pocket at these folded sections thus soiling the wearer. Also, the folded sections themselves become covered in food debris and liquid making it more difficult to clean when unfastened. A third flaw is potentially found the folding process and fastener locations for forming the temporary pouch as it is not more complicated solution therefore requiring the user to obtain instructions in order to correctly form the pocket.

Another design flaw found in some proposals for pockets is if a pocket does not project or bow outward and away from the body of the bib, it will fail to catch food debris and liquid.

A fourth issue related to some bib designs is the inability to adjust the upper portions of the bib at the wearers neck for both a comfortable fit and also to prevent food particles and liquid from falling beneath the bib and soiling the user at the neck.

A fifth problem noted on some bibs is the lack of protection to the wearer's shoulders. Babies, especially, have a tendency to wipe their faces on their shoulders therefore creating a need for this area of the bib to be addressed.

Accordingly, there remains a need for a pliable, waterproof, reusable bib having a releasable pocket formed in its lower section for receiving and retaining food particles and liquid. It is also desirable that such a bib be adjustable in the neck, provide protection over the shoulders, and be easily cleaned.

SUMMARY OF THE INVENTION

In relation to the present invention, a bib that acts as a barrier against soiling to the wearer comprised a body made of a continuous sheet of durable, pliable, waterproof and soil resistant material which is easily cleaned by wiping or washing as apposed to bibs that are made of woven fabric, knitted fabric, paper or other lightweight non-waterproof and non-soil resistant materials.

The body consists of two upper sections for placement on opposite sides of the wearer's neck that assist in protecting the wearer's shoulders from soiling. These upper sections incorporate adjustable co-operative snaps that temporarily fasten the two upper sections together to accommodate a range of neck sizes. In fastening the upper sections together, a portion of the bib body fashions to the wearer's chest and shoulders.

The bib body includes a lower section that folds and fastens into a bowl-like pocket for catching and retaining solid and liquid material. The lower section comprises a pocket front consisting of two layers of fabric assisting to keep the pocket in an open position, which when fastened bows outwardly creating the bowl-like pocket. The lower section also is designed with semi-circular portions on the left and right sides of the bib, which are critical for forming the bowl-like pocket.

The pocket is formed firstly by folding the left and right corners of the lower body upwards toward the front of the body and fastening each of these two corners' snaps to its corresponding snaps on the left and right side of the bib. The bib is then positioned so that the back of the body is facing upright. Next, the second set of precisely located snaps found on the left and right corners at the bottom of the partially formed pocket (which is also the widest point of the semi-circular portions), are now are folded upwards on an angle and fastened to each of two corresponding snaps precisely and strategically located on the back of the bib equidistant to the centerline of said fold so that the edges which once formed the left and right sides of the bib now are positioned horizontal and parallel to the top of the pocket on the front of the bib body.

The resulting pocket does not have any folds inside of it to encumber the operation of said pocket thus making it impossible for liquid to leak. It is only necessary to unfasten the pocket for the purpose cleaning, which due to the semi-circular design on the left and right sides of the lower body and the strategic location of the snaps for forming said pocket, can quickly and easily accomplished when removed from the wearer.

It is the object of the present invention to provide a new and improved bib, which has a bowl-like pocket formed out of its lower body that is leak-proof. The integrity of the pocket to retain liquid and food particles is assured and maintained by the special manner in which it is the lower body is shaped, folded and constructed; by the precise location of corresponding snaps; by the use of a washable, resilient, waterproof and soil-resistant material; by eliminating any folds within the inside structure of the pocket and also by ensuring that no perforations occur inside the pocket which could cause liquid to leak. The resulting pocket provides a very easy to clean surface when unfastened.

DETAILED DESCRIPTION OF THE PREFERRED EMBODIMENT OF THE BIB

Figure 1:
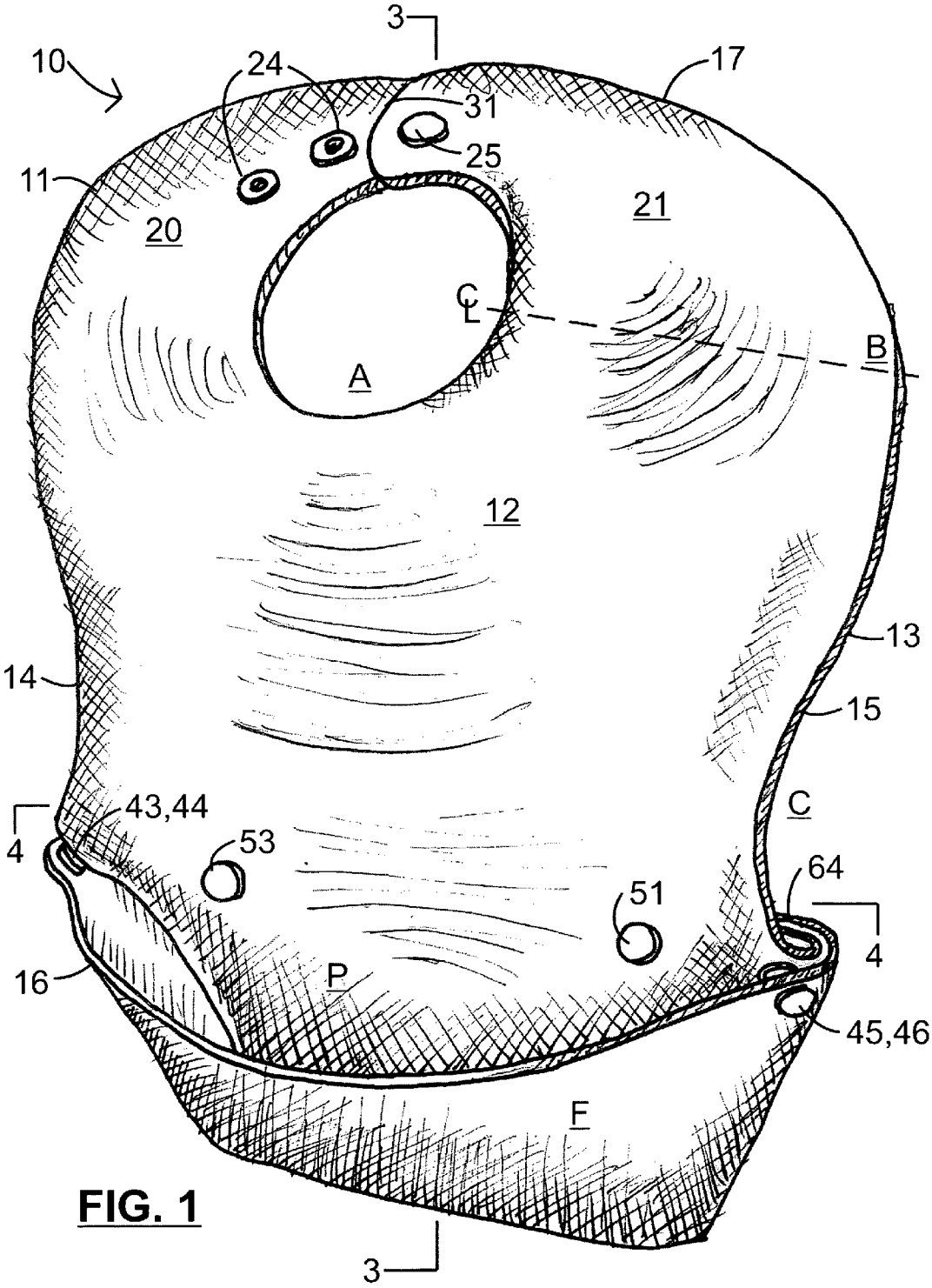
FIG. 1 is a perspective view of a bib embodying the present invention.
Figure 2:
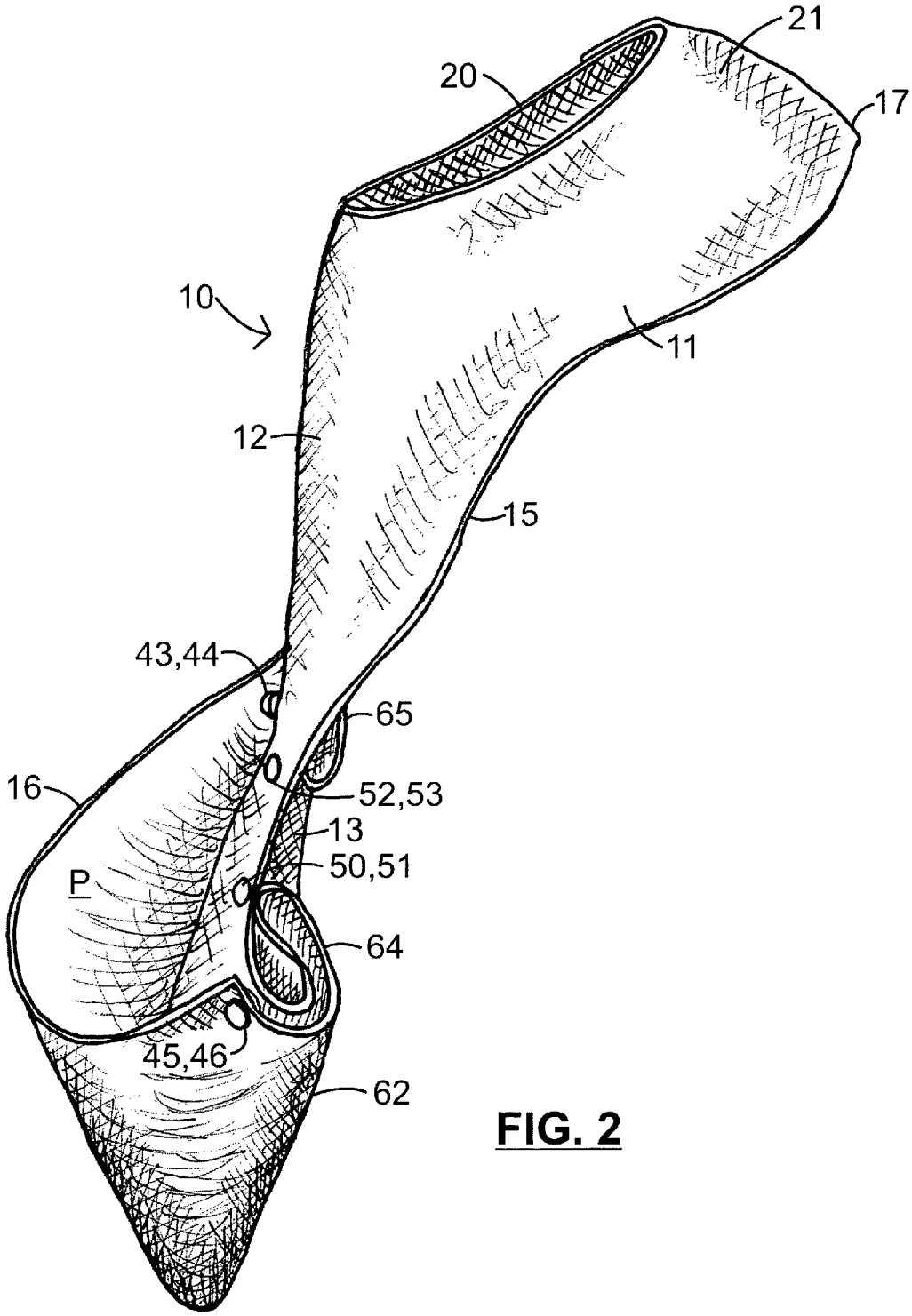
FIG. 2 is a side perspective view of a bib embodying the present invention.
Figure 3:
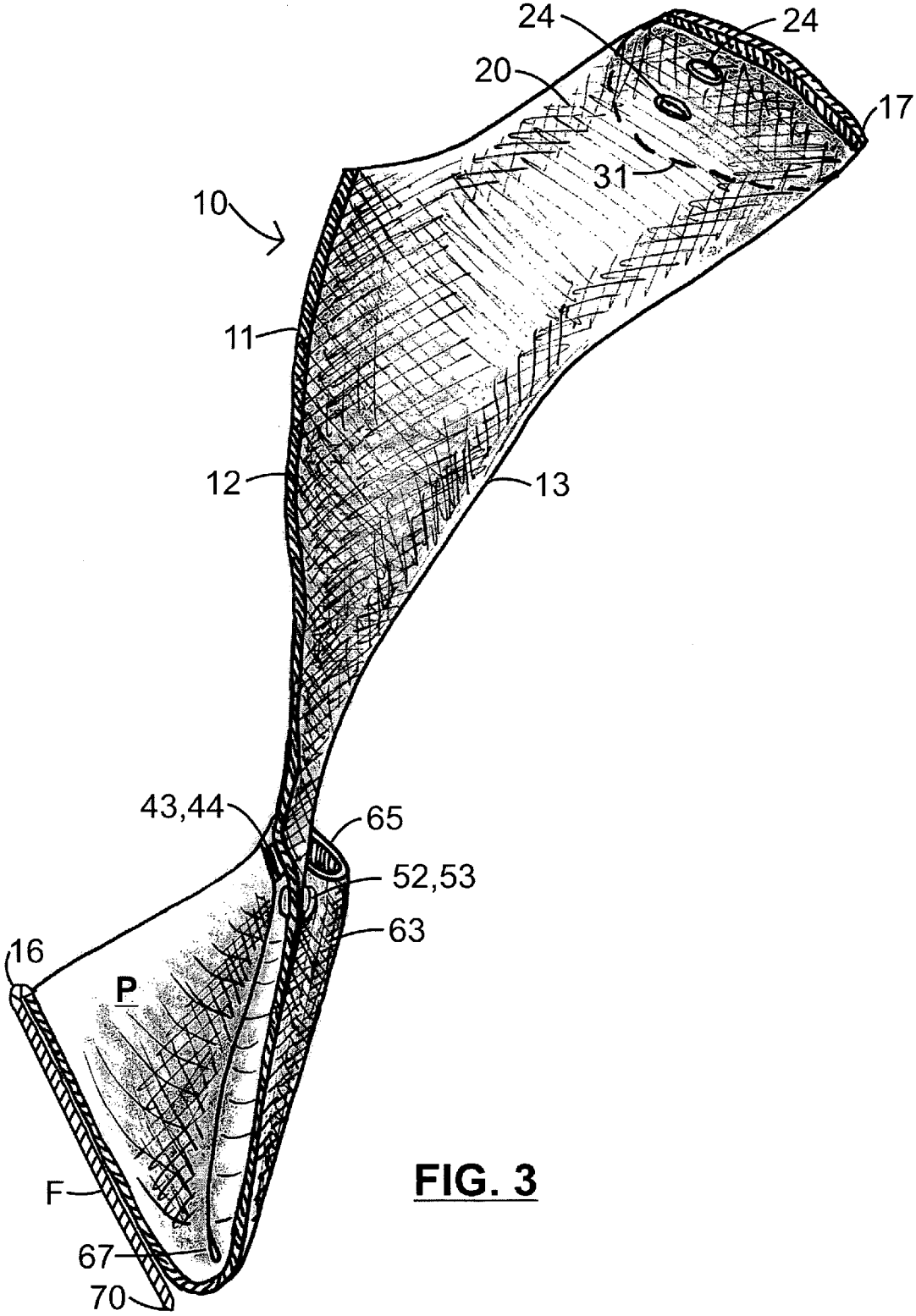
FIG. 3 is a vertical sectional view of a bib embodying the present invention as seen from the plane indicated by the lines 3-3 of FIG. 1.
Figure 4:
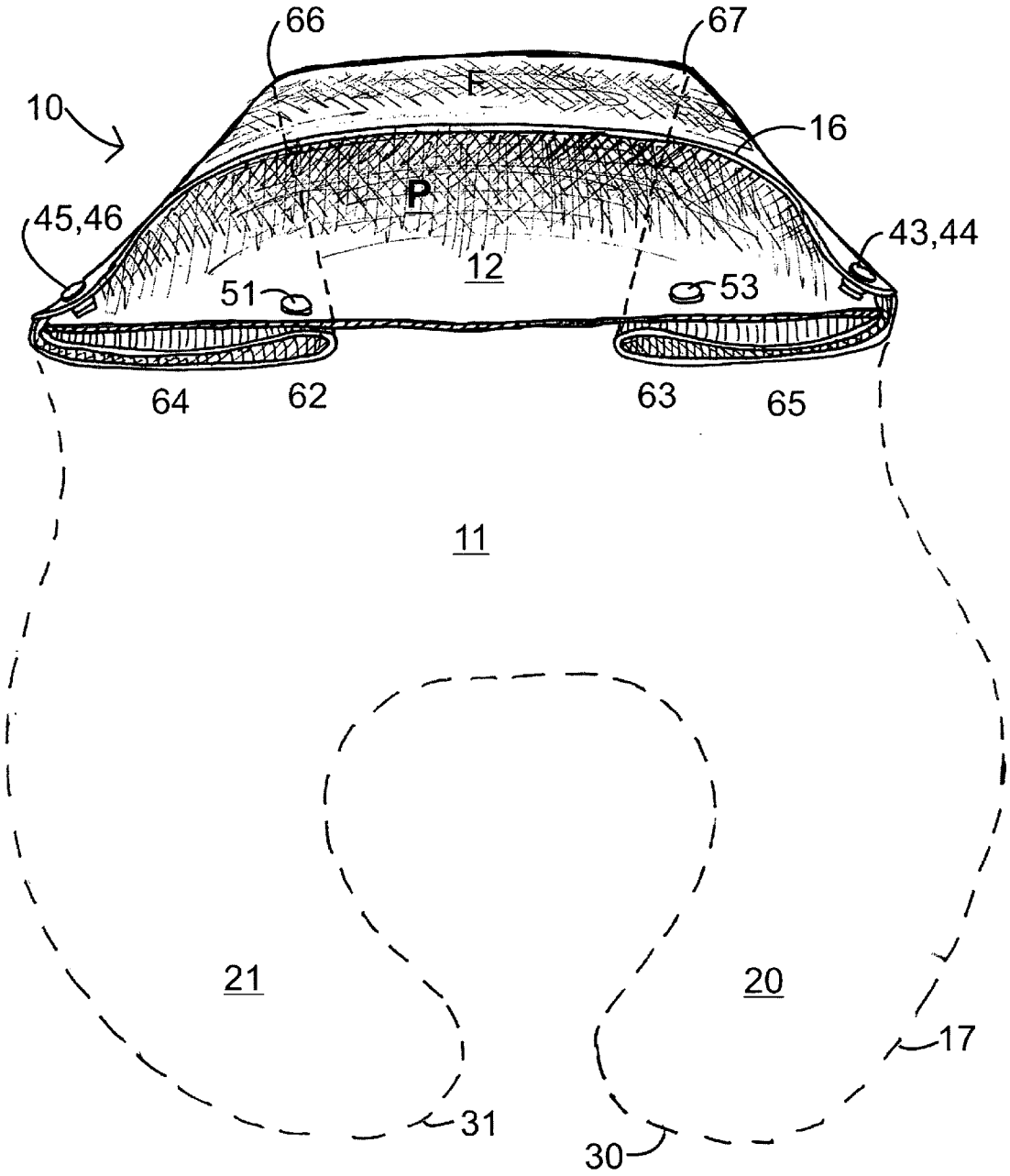
FIG. 4 is a horizontal sectional view of a bib embodying the present invention as seen from the plane indicated by the lines 4-4 of FIG. 1 and having the remaining portion of the bib indicated in phantom lines.
Figure 5:
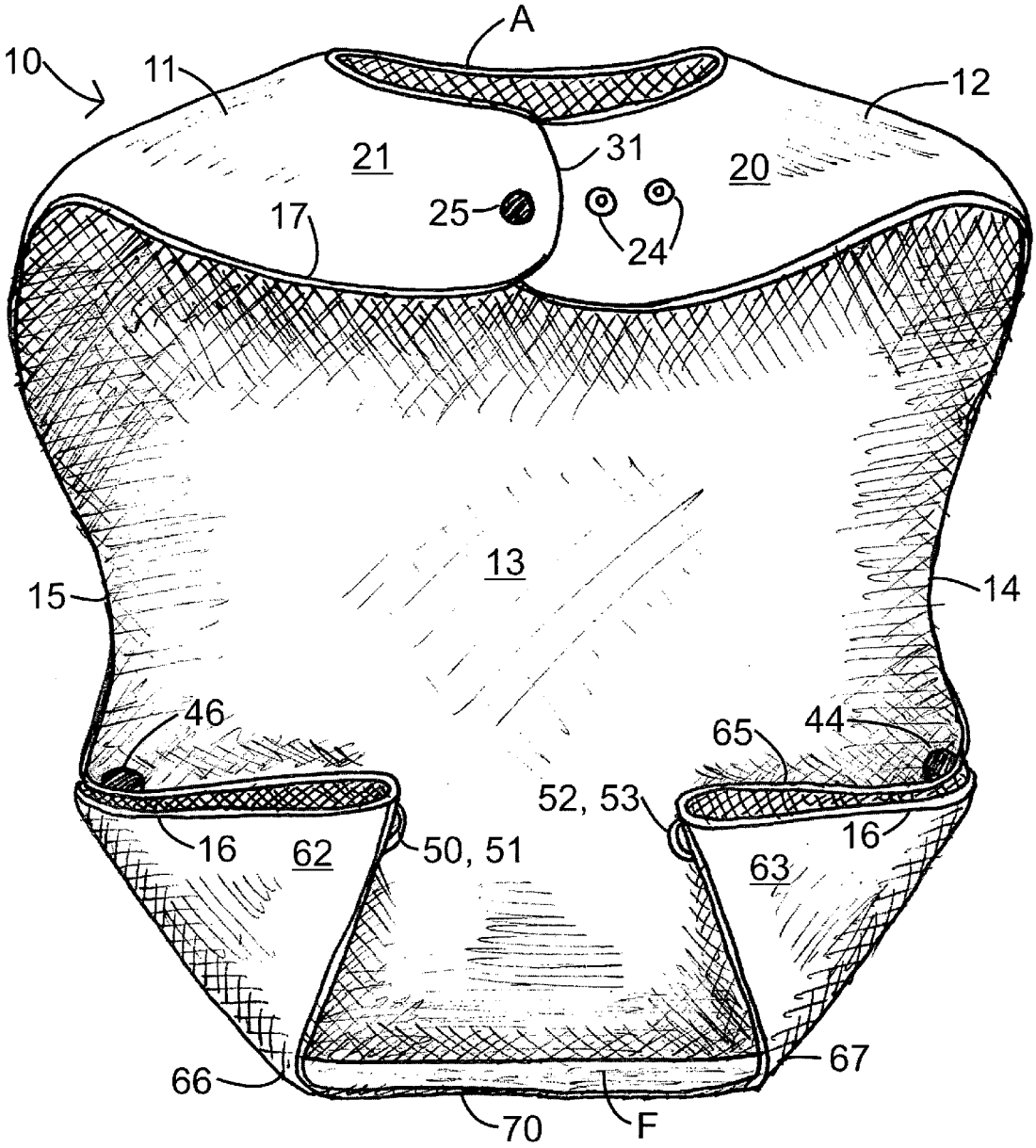
FIG. 5 is a rear perspective view of a bib embodying the present invention.

Turning to the drawings, a bib 10 is illustrated. The bib 10 has a body 11 that has a front 12 and a back 13. The body 10 further includes two opposing side edges 14 and 15, as well as a bottom edge 16, and a top edge 17.

In the preferred embodiment, the body 11 has two upper sections 20, 21. The two upper sections 20, 21 each being increasingly widening semi-circular segments are for placement on opposite sides of the wearer's neck.

Located on the two upper sections 20, 21, are cooperative snaps 24, 25. The snaps 24, 25 are located just inward from the tips 30, 31 of the upper sections 20, 21.

Figure 7:
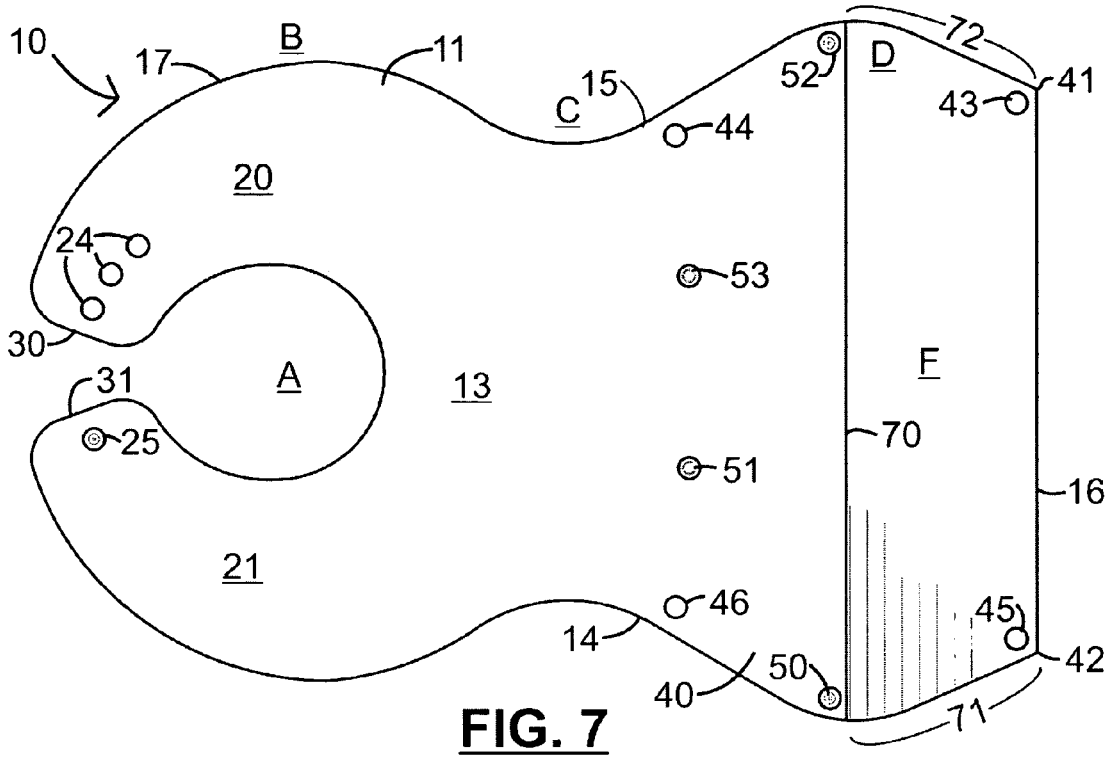
FIG. 7 is a rear elevational view of a bib embodying the present invention with the pocket unfolded.
Figure 6:
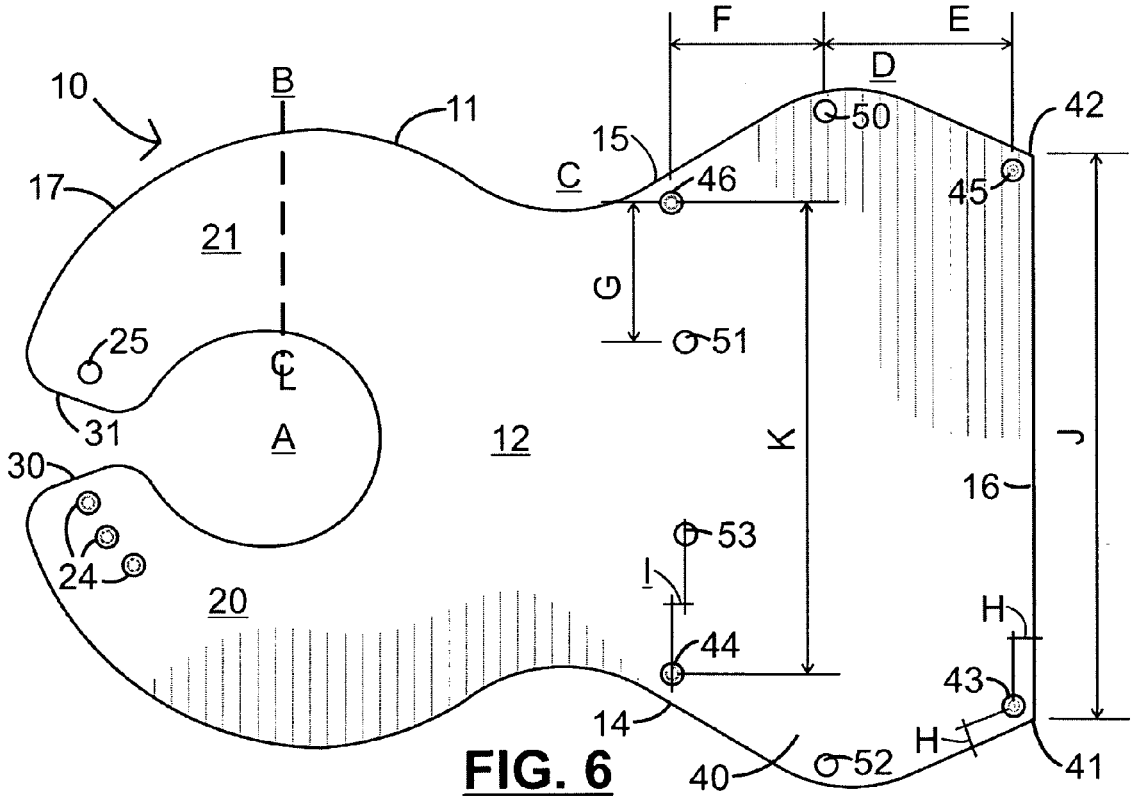
FIG. 6 is a front elevational view of a bib embodying the present invention with the pocket unfolded.
Figure 8:
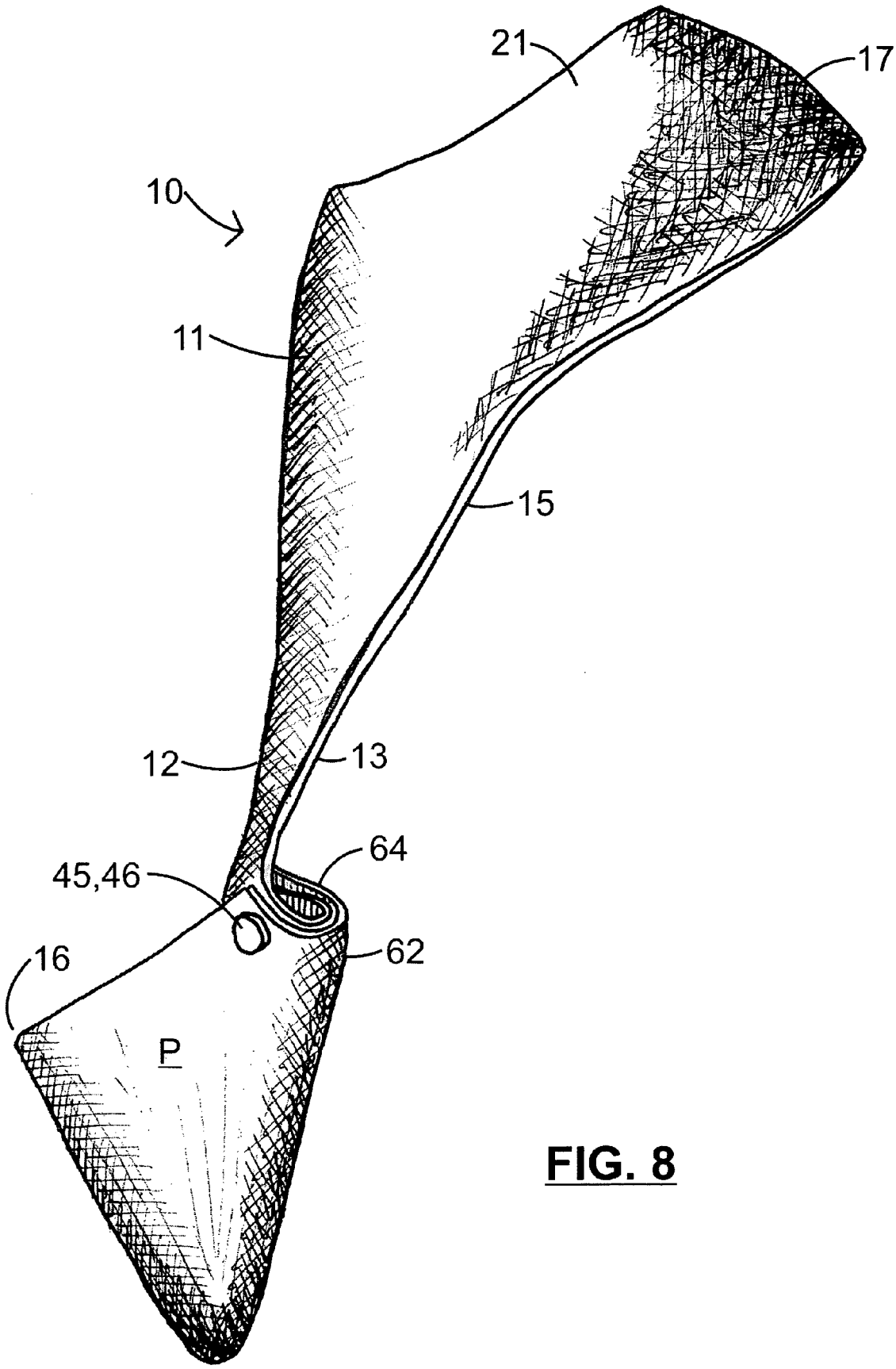
FIG. 8 is a side elevational view of a bib embodying the present invention with the pocket folded and attached.
Figure 9:
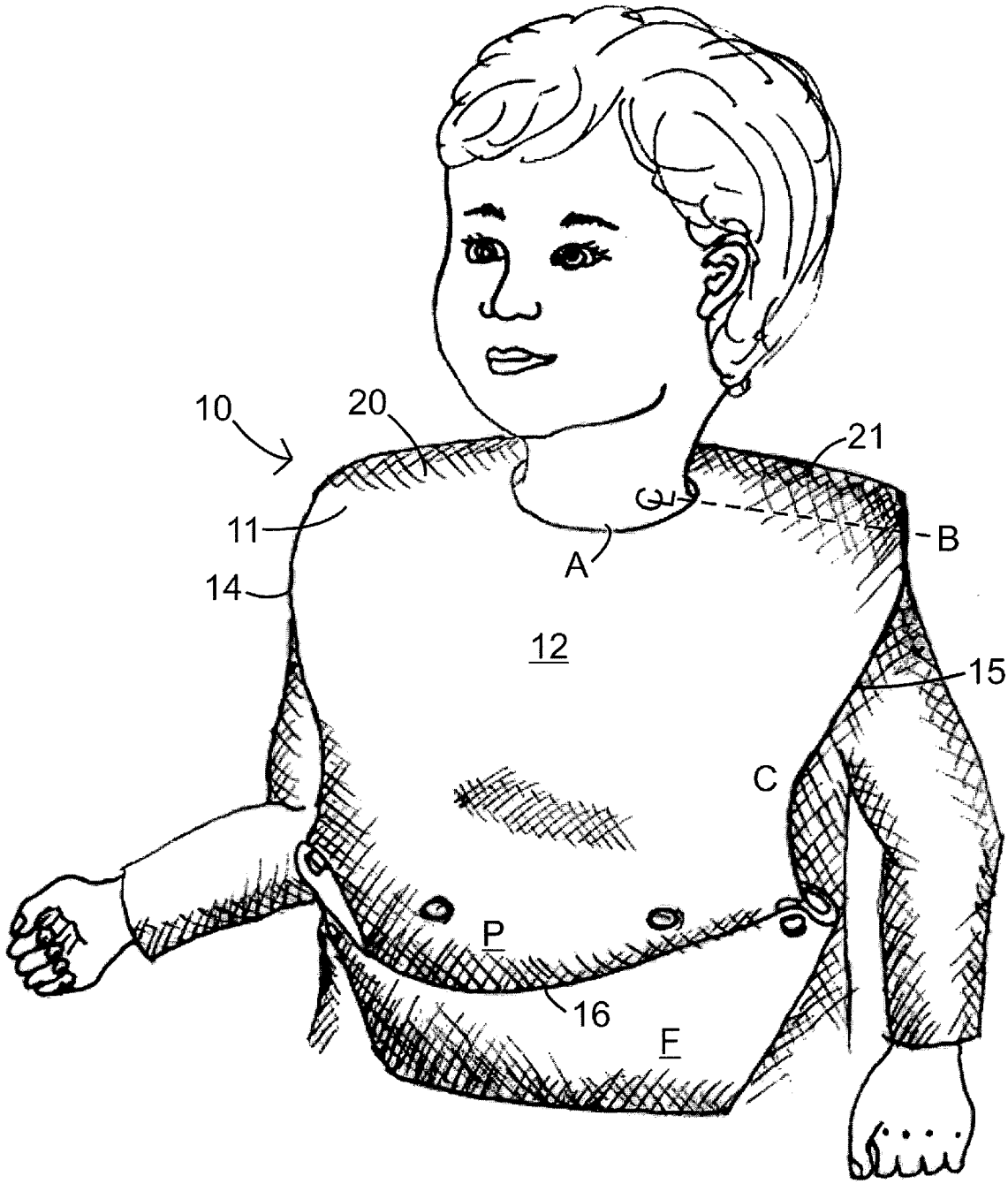
FIG. 9 is a perspective view a child wearing a bib embodying the present invention.

As best seen in FIGS. 6 and 7, the upper sections do not meet when laid flat and the opening A is substantially circular when the snaps 24, 25 are not fastened. However, as best seen in FIGS. 1 and 9, when the snaps 24, 25 are fastened together, opening A becomes elliptical in shape causing the body 11 to conform to the wearer's chest, shoulders and neck. In fastening the upper sections together, a portion of the bib body arcs outwardly to conform to the wearer's body and due to the placement of the increasingly widening semi-circular upper sections over the shoulders of the wearer, rotation of the bib is virtually eliminated thus preventing solid or liquid food material from coming into contact with the user at its sides.

As best seen in FIGS. 6 and 7, the upper sections 20, 21, are substantially circular and are the widest at the centerline of radius B which is also at the centerline of opening A. The upper sections 20, 21 then taper inwards toward the body 11 at radius C. When snaps 24, 25 are fastened together around the wearer's neck, these wider circular upper sections act to substantially protect the shoulder area from soiling. Also, when snaps 24, 25 are fastened, radius C is positioned adjacent the wearer's arms allowing movement of the arms which results in a better fit allowing the bib 10 to protect the wearer more completely from spills.

As best seen in FIGS. 6 and 7, the bib body 11 includes a specially designed lower section 40 that consists of a pocket face F that has been pre-constructed by having folded a section of the lowest portion of the body material 70 under and permanently affixing on the sides 71, 72 and edge 16.

The lower section further comprises an arc D on either side 14, 15 of the lower section 40 that both terminate into opposite corners 41, 42. Two sets of cooperative snaps 43, 44 and 45, 46 are located near the side edges 14, 15 in the lower section 40. Snaps 43 and 45 are male snaps and are located on the front 12 with the corresponding female snaps 44 and 46 also located on the front 12.

Two more sets of cooperative snaps 50, 51 and 52, 53 are located in the lower section 40 of the bib. Snaps 50 and 52 are male snaps and are located on the back 13 of the bib near the side edges 14, 15. The corresponding female snaps 51 and 53 are functionally located on the back 13 of the lower section 40, horizontally adjacent snaps 44 and 46 at distance G toward the center of the bib, and vertically offset at distance I toward the bottom edge 16.

In the preferred embodiment, the overall length L of the bib is 17½" and the overall width W is 12½". Distance E is 2⅞", distance F is 3⅜", distance G is 2⅝", distance H is ½", distance I is ¼", distance J is 9⅞" and distance K is 8⅝.

To form the pocket P, snaps 43 and 45 located on pre-constructed pocket face F are brought up and fastened to their corresponding snaps 44 and 46 on the front of the body 12. Then, snaps 50 and 52 are brought around and up to the back and fastened to their corresponding snaps 51 and 53 on the back of the body 13. As best seen in FIGS. 1, 2, 3, 4, 6, 8 & 9 the bottom edge 16 now forms the top edge of the pocket P, which bows outwardly due to the lengths of J and K. As best seen in FIGS. 2, 3, 4 & 5, portions 62, 63 of the body 11 and the pre-prepared pocket face F add rigidity and stability to pocket P. The counterbalancing effect created between portions 62, 63 and the front flap F of pocket P aid in holding the pocket open. The resulting appearance of the pocket is bowl-like and stable in its construction.

As best seen in FIGS. 3, 4, 5 & 9 the pocket is leak resistant. In order for liquid to escape the pouch P, the pouch will need to fill with liquid to a level sufficient to reach edges 16, 64 & 65. Due to the unique nature of how the pocket is folded and fastened, liquid cannot leak at its corners 66, 67.

In order to clean the bib, snaps 24, 25 are unfastened and the bib is removed from the wearer. Snaps 50, 51 and 52, 53 are unfastened and then snaps 43, 44 and 45, 46 are unfastened to allow the bib to return to its flat sheet-like appearance. Any contents of the pouch are simply removed and discarded, and wiping or washing easily cleans the bib. The bib is made of a washable, resilient, waterproof and soil-resistant material.

The preferred embodiment of the invention has been described and illustrated in detail although it should be noted that the present invention is not to be considered limited to the precise design covered. Different variations, adjustments, adaptations and uses of the invention may occur to those skilled in the area to which the invention relates and the intention is to hereby cover all such possible variations, adjustments, adaptations and uses, which fall within the character or scope of the appended claims.

The embodiments of the invention in which an exclusive property or privilege is claimed are defined as follows:

1. A bib that has a leak-proof bowl-like pocket comprising a body having a front and a back, left and right opposing side edges, a bottom edge and a top edge and being made of a resilient, waterproof and soil-resistant material, the body including:

two upper sections for placement around the wearer's neck, the two upper sections when fastened around the wearer's neck cause the bib body to arc outwardly and act to hold the bowl-shaped pocket in an open configuration;

a lower section wherein the left and right side edges of said lower section each define a convex arced segment, which is integral in forming the bowl-shaped pocket;

two pairs of first cooperative snaps placed on the front of the body, with a first snap of each pair of cooperative snaps on each of the left and right bottom corners which is a lower end of the convex arced segment, with the corresponding cooperative snaps of the pairs placed at upper ends of the convex arced segments on the front of the bib, with the two cooperative snaps of each pair being vertically equidistant from a horizontal centerline of the pocket to be formed, and the two pairs of first cooperative snaps when fastened will create a partially formed pocket having a new bottom edge comprising a fold and will cause the pocket front to arc away from the wearer creating a bowl-shaped pocket;

and two pairs of second cooperative snaps both located on the back of the bib, with a first snap of each pair of cooperative snaps on the new bottom edge lowest right and left corners of the partially formed bib which is the center point of the convex arced segments, and the corresponding cooperative snaps placed horizontally toward the center of the body adjacent the corresponding cooperative snaps of the pairs of first cooperative snaps and equal in distance to that of a vertical depth of said pocket;

the pocket being formed firstly by folding each of the two lower left and right corners of the lower body upwards toward the front of the body and fastening each of these two corners' cooperative snaps to its corresponding cooperative snap on the left and right side of the bib, then by positioning the bib so that the back of the body is accessible, the second cooperative snaps found on the left and right corners at the bottom of the partially formed pocket on the back side of the body are now folded upwards on an angle and fastened to each of the two corresponding cooperative snaps located on the back of the bib equidistant to the centerline of said fold so that the edges which once formed the left and right side edges of the bib are now positioned horizontal and parallel to the top of the pocket on the front side, the resulting pocket being free from folds within its internal structure making it leak-proof on the sides and bottom of said pocket.

2. The bib of claim 1 wherein the two upper sections for placement around the wearer's neck act to protect the wearer's shoulders from soiling.

3. The bib of claim 1, wherein when the snaps are unfastened, the bib body is flat and sheet-like such that the bib may be wiped clean.

4. A bib with a bowl-shaped pocket, the bib having a body with a front and a back, left and right opposing side edges, a bottom edge and a top edge, the body comprising:

two upper sections that when fastened around the wearer's neck, cause the bib body to arc outwardly and act to maintain the bowl-shaped pocket in an open configuration;

a lower section having opposing arcs on the left and right side edges;

two pairs of first cooperative snaps on the lower section on the front side of the bib, with a first snap of each pair of cooperative snaps on each of the left and right bottom corners at a lower end of each arc on the left and right sides of said lower section, with the corresponding cooperative snaps located at upper ends of said arcs, with the two cooperative snaps of each pair being vertically equidistant from a horizontal centerline of the pocket to be formed, wherein the two sets of first cooperative snaps when fastened will cause the pocket front to arc away from the wearer forming a bowl-shaped pocket;

and two pairs of second cooperative snaps both located on the back of the bib in the lower section, with a first snap of each pair of cooperative snaps located on the widest part of each arc on each of the left and right sides of said lower section, the corresponding cooperative snaps being located adjacent the corresponding cooperative snaps of the pairs of first cooperative snaps, placed horizontally toward the center of the body equal in distance to that of a vertical depth of said pocket;

wherein the pocket is formed firstly by folding each of the left and right corners of the lower section upwards toward the front of the body and fastening each of these two corners' cooperative snaps to its corresponding cooperative snap on each side, so as to create a partially formed pocket with newly created left and right bottom corners; secondly, on the back of the body in the lower section of the partially formed pocket, the two cooperative fasteners located on the newly formed left and right bottom corners are folded upwards on an angle toward the center of the bib so that the edges which once formed the left and right side edges of the body become parallel to the bottom of the pocket and aligned with a front top of the pocket, by fastening each of these two corners' cooperative fastener to its corresponding cooperative fastener on the back side of the body, and the resulting pocket is free from folds within its internal structure making it leak-proof on the sides and bottom of said pocket.

5. The bib of claim 4 wherein the two upper sections create a circular shaped opening for placement around a wearer's neck and over the shoulders.

6. The bib of claim 4 wherein unsnapping the pocket creates a flat bib body to facilitate wiping or washing of the surface of the body.

7. The bib of claim 4 wherein the upper sections can be connected and released from around the wearer's neck, and the lower section forming the pocket can be connected and then released by fastening and unfastening the snaps, as required to allow for wiping and/or washing the bib.

8. The bib of claim 4 wherein the pocket formed from the lower section unfastens for the purpose of wiping and/or washing the body of the bib when removed from the wearer.

9. The bib of claim 4 wherein:

the lower section comprises two layers of waterproof material formed by folding the lower section under and permanently affixing along the sides and fold line to add extra rigidity and durability to the pocket, to ensure the pocket will stay open and retain its bowl-shaped appearance, wherein the lower section is folded and fastened in a manner whereby folds do not occur within the pocket itself that could allow food particles and liquid to leak, the resulting pocket being free from perforations which could cause liquid to leak from said pocket, and the resulting pocket prevents liquid leakage at the sides and maintains a bowl-like structure.

10. The bib of claim 4 wherein the integrity of the pocket to retain liquid and food particles is assured and maintained by its construction, thus preventing soiling to the wearer.

* * * * *